United States Patent [19]

Tompkins

[11] Patent Number: 4,469,247

[45] Date of Patent: Sep. 4, 1984

[54] BLAST AERATOR

[75] Inventor: L. Kirk Tompkins, Little Rock, Ark.

[73] Assignee: Global Manufacturing Inc., Little Rock, Ark.

[21] Appl. No.: 354,310

[22] Filed: Mar. 3, 1982

[51] Int. Cl.[3] ..... B67B 7/24

[52] U.S. Cl. ..... 222/3; 222/195; 137/199

[58] Field of Search ..... 222/1, 3, 195, 354, 222/630, 637; 137/202, 199, 197

[56] References Cited

U.S. PATENT DOCUMENTS

| | | | |
|---|---|---|---|
| 3,905,515 | 9/1975 | Allemann | 222/3 |
| 4,197,966 | 4/1980 | Wadensten et al. | 222/3 |

*Primary Examiner*—H. Grant Skaggs
*Assistant Examiner*—Kenneth Noland
*Attorney, Agent, or Firm*—Stephen D. Carver

[57] ABSTRACT

A blast aerator for dislodging bulk materials in storage hoppers or the like. The blast aerator preferably comprises a rigid, generally cylindrical tank with a blast discharge opening coaxially aligned with its axis. A blast discharge assembly coupled to the discharge opening includes an elongated, one-piece, rigid discharge pipe of a predetermined internal diameter. A valve seat assembly is coaxially secured against an internal shoulder of the pipe. A resilient dual diameter piston is disposed within an intermediate portion of the pipe for axial movement between a sealing position wherein its reduced diameter portion abuts the valve seat assembly and a rearward, aerator fill position. The larger diameter portion of the piston axially tracks wthin the intermediate diameter portion of the discharge pipe. A valve cap assembly is coaxially secured at the end of the discharge pipe internally of the tank, defining a cavity between it and the piston rear. Means coupled to the valve cap and activated externally facilitate operation of the aerator by periodic pressurization of the cavity (and thus the tank). The piston is urged rearwardly when the cavity is vented to facilitate a blast by pressure acting upon a shoulder defined between its intermediate and reduced diameter portions.

6 Claims, 7 Drawing Figures

19
36
86
26
39
35
37

8B
38
27B
84
75
68B
65
64
74
66
8
40
27
67
69
68
70B
58
70
82
54
71
56
72
55
73
57
59
60
61B
61
61E
62
63

BLAST AERATOR

BACKGROUND OF THE INVENTION

The present invention relates generally to air blaster or air accumulator devices adapted to periodically discharge air to facilitate the flow of bulk materials. Such devices, more precisely referred to as blast aerators, are believed to be relevantly classified in U.S. Class 222, Subclasses 1 and 3.

It is well known that in handling or processing bulk loads such as concrete, grain, wood chips or other materials the hoppers or storage bins involved can often become jammed or temporarily blocked. Such materials usually tend to cake or congeal during bulk processing. For example, flow problems are quite common with the conventional, generally conically shaped hoppers in widespread use. While bulk flow problems may of course be temporarily remedied by physically vibrating the hopper or container to shake the materials loose, not all materials may be dislodged in this manner. For example, large concrete bunkers may be impossible to vibrate. Materials like soft wood chips ordinarily absorb vibratory energy and must be dislodged by other methods.

In the prior art it has been suggested to dislodge bulk materials to promote smooth material flow by periodically introducing high pressure air blasts into the jammed container. Typically blast aerators are physically mounted exteriorly of the hopper, and introduce periodic high pressure charges of air to dislodge the material. Examples of prior art technology believed most relevant to the present invention may be seen in the following previously issued U.S. Pat. Nos. 3,915,339; 4,197,966; 3,651,988. Other relevant blast aerator technology is disclosed in Great Britain Pat. Nos. 1,426,035 and 1,454,261; West German Pat. No. 2,402,001; and Austrailian Pat. No. 475,551. Less relevant prior art, in which pressurized air is utilized to project tennis balls or the like, may be seen in the following previously issued U.S. Pat. Nos. 2,935,980; 1,379,403; 2,182,369; and 2,525,082.

Quick release aerators of the type disclosed in the above mentioned patents have gained widespread acceptance as useful remedies for bulk flow problems. However, because of a variety of mechanical weaknesses inherent in previous aerator construction techniques, mechanical efficiency and reliability has been questionable. More importantly, the periodic high pressure, high volume air discharges generated by air blaster subject internal parts to extreme stresses which promote component failure. As will be readily appreciated, failure of critical structural parts, primarily the piston housing members employed by such devices, may result in severe injury to operating personnel. Even where injury is avoided, aerator component breakdown may severely limit operational efficiency of the bulk flow system on which the aerator has been installed. Component breakdown has been found to result at least in part from the hitherto multi-piece construction of the piston housing assembly or blast output pipe.

Piston wear and tear is another problem. In prior art designs that portion of the piston utilized to create a seal also functions as the working surface upon which tank pressure works to force the piston to its "blast" position. Blasting is initiated, for example, by venting the cavity formed between the piston rear and the discharge pipe assembly in which it is housed. It is thus desireable to provide a piston sealing surface separate from its blast actuation surface.

SUMMARY OF THE INVENTION

The present invention comprises a blast aerator characterized by an integral, one-piece elongated tubular blast output pipe in which a dual diameter piston is disposed. A similar one-piece blast output pipe adapted for use with aerator tanks is also disclosed.

The blast aerator includes a rigid, generally cylindrical, tank terminating in a front end provided with an output hole and a preferably flanged mounting coupling. The blast discharge valve assembly constructed in accordance with the teachings of this invention is adapted to be coaxially, flangably secured to the output tank flange to facilitate perodic air discharges in a manner to be described.

The blast output pipe is formed from a one-piece pipe, and it includes an output end which normally projects outwardly from the tank and a rear end adapted to be positioned within the tank. An internal shoulder securely maintains a valve seat assembly in a correct operative position, preventing its inadvertent discharge through the blast pipe to insure against potential injury. One or more vent orifices are defined in the periphery of the discharge pipe near the valve seat assembly to facilitate an air blast.

A resilient, cylindrical dual diameter piston is slidably disposed within an intermediate portion of the discharge pipe, and is axially displaceable between an aerator fill position and an aerator discharge position. In the fill position a seal is maintained when the chamfered end of the reduced diameter piston portion matingly, sealingly contacts a similarly chamfered seat portion of the valve seat assembly. An end cap assembly sealably terminates the pipe, and prevents rearward escape of the piston.

Air is introduced into the aerator through a valve control system, including a fitting mated to the end cap. As air is introduced into the cavity formed between the rear of the piston and the end cap, the piston is urged into sealing engagement with the piston seat assembly, and air escapes from the cavity through a check valve secured to the end plate to fill the tank. After the aerator tank is thus pressurized, an electric solenoid valve may depressurize the cavity to allow the piston to move rearwardly. At this time tank pressure acting upon the piston shoulder, which separates the reduced diameter portion from the larger diameter portion, will thrust the piston toward the end cap, exposing the pipe vents. As the piston virtually instantaneously assumes its rearwardmost position, air stored within the tank rapidly escapes from the blast output pipe, entering the blast pipe through the exposed vent orifices for subsequent injection interiorly of the hopper or other application.

Total control of the aerator is achieved exteriorly of the tank, access being permitted at a frontal location. Since an air fitting is mounted with respect to the blast pipe flanges, no additional tank machining, welding or the like is required to facilitate installation.

Thus a broad object of this invention is to provide an extremely reliable and safe blast aerator.

A similar object of this invention is to provide a blast aerator of the character described characterized by a unitized blast output pipe.

Yet another object of this invention is to provide a valve seat assembly locking system for use with blast aerators which may not be dislodged inadvertently through the output pipe.

Another object of the present invention is to provide a unitary blast output pipe which may be quickly and reliably installed during manufacture, or which may be easily replaced during aerator maintenance.

A further object of this invention is to prevent or minimize the chances of operator injury.

Still another object of the present invention is to assure absolute alignment of the operating piston and its cooperating seat. To this effect it is a feature of the present invention that the discharge valve pipe is precisely machined in one-piece.

Yet another important object of this invention is to maximize the efficiency and life of the aerator piston.

A related object is to provide a piston system for a blast aerator in which the sealing portion is separated from the blast activation portion. It is an important feature of the present invention that a dual diameter piston is employed. The reduced diameter front is chamfered for efficient sealing. And, the shoulder portion between the different diameters constitutes the "working surface" upon which tank pressure acts to initiate a blast.

A still further object is to provide a blast pipe assembly of the character described which can easily and efficiently be employed with existing aerator tank designs.

These and other objects and advantages of this invention, long with features of novelty appurtenant thereto, will appear or become apparent in the course of the following descriptive sections.

BRIEF DESCRIPTION OF THE DRAWINGS

In the appended drawings, which form a part of the specification and which are to be construed in conjunction therewith, and in which like reference numerals have been employed throughout to indicate like parts in the various views.

DETAILED DESCRIPTION OF THE DRAWINGS

Figure 1:
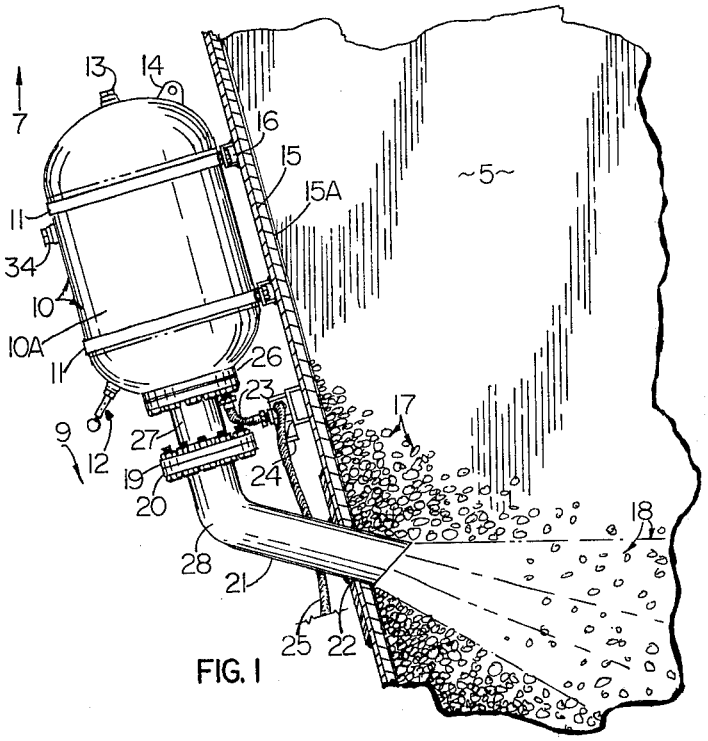
FIG. 1 is an isometric, pictorial view illustrating proper operational placement of a blast aerator constructed in accordance with the teachings of this invention upon a hopper or storage bin, with parts thereof broken away for clarity.
Figure 2:
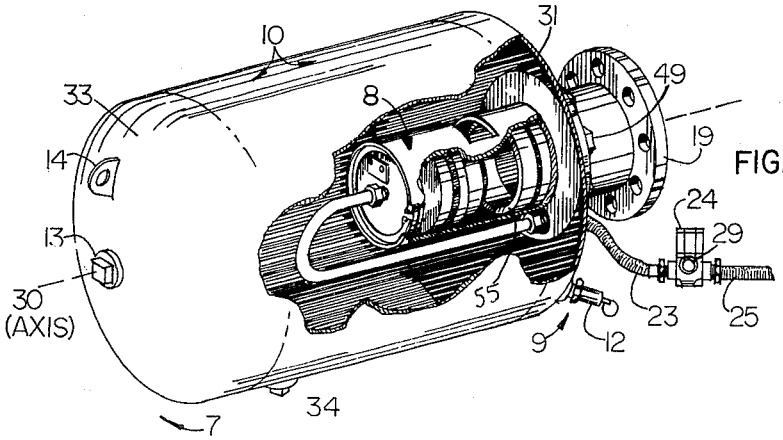
FIG. 2 is an enlarged, isometric view of a blast aerator constructed in accordance with the teachings of this invention, with parts thereof broken away or shown in section for clarity.

With initial reference now to FIGS. 1-4 of the drawings, a blast aerator constructed in accordance with the teachings of the present invention is generally designated by the reference numeral 10. Aerator 10 comprises a rigid, generally cylindrical, preferably steel tank 10A secured to a hopper 5 (or other application) by a pair of conventional, spaced-apart mounting straps 11. Straps 11 are secured by mounting cradles 16 to the wall 15 of the hopper. Bulk material, generally designated by the reference numeral 17, disposed within hopper 5 within wall liner 15A is periodically agitated by an air blast, generally designated by the reference numeral 18.

The front 9 of the tank 10A preferably includes a pressure relief valve 12, which is aimed downwardly such that it will facilitate drainage of the tank interior when necessary. Preferably an end plug 13 of conventional construction is disposed at the rear 7 of the tank 10A. Preferably the tank includes a lifting lug 14 at its rear to facilitate maneuvering. Tank 10 also includes a discharge orifice 9B (FIG. 4) to which a blast control pipe system, generally designated by the reference numeral 8, is mechanically coupled. The tank end head 31 mounts a tank flange 32 coaxially positioned relative to axis 30 of the aerator 10. An optional side plug 34 may be fitted to conventional accessory port 52 to permit drainage, inspection or the like. End plug 13 is received within conventional accessory port 53 defined in the opposite tank end head 33.

The blast pipe apparatus 8 includes an elongated, substantially tubular body 27 (FIGS. 5, 6) which includes a front portion 8B terminating in a blast discharge opening 37. Spaced-apart sets of pipe threads 38 are provided to threadably mount a pair of spaced-apart flanges 19, 26. As best viewed in FIG. 5, that portion of tube 27 located between flanges 19, 26 is identified by the reference numeral 27B. Flange 19 is adapted to be matingly secured to a suitable, conventional terminal flange 20 (FIG. 1) secured to a discharge pipe 21 which preferably enters the interior of hopper 5 at an angle. A wall flange mounting 22 is provided for mechanical strength. A long radius bend, generally designated by the reference numeral 28, has been found advantageous in actual use.

In assembly the blast discharge tube apparatus 8 will be secured relative to tank 10 when its flange 26 is coupled with suitable bolts penetrating orifices 35 and received and anchored within tank flange bolt holes 44 (FIG. 4) defined in tank flange 32. A suitable gasket 46 including aligned gasket holes 48 will be interposed between flanges 32, 26.

Figure 4:
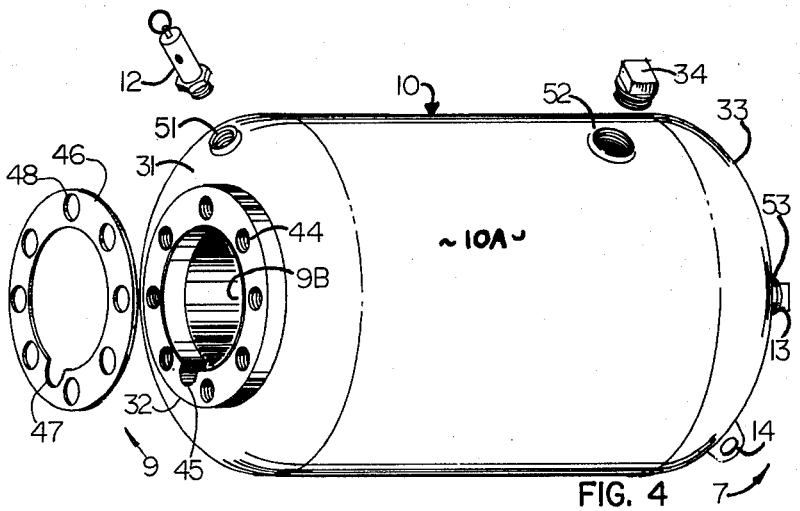
FIG. 4 is enlarged, exploded pictorial view illustrating operational placement of associated aerator hardware.

Flanges 26, 32 may be coupled together with suitable bolts 49 (FIG. 5) including washers 50, which penetrate holes 35 to be received within the tank flange threaded orifices 44 (FIG. 4).

Figure 5:
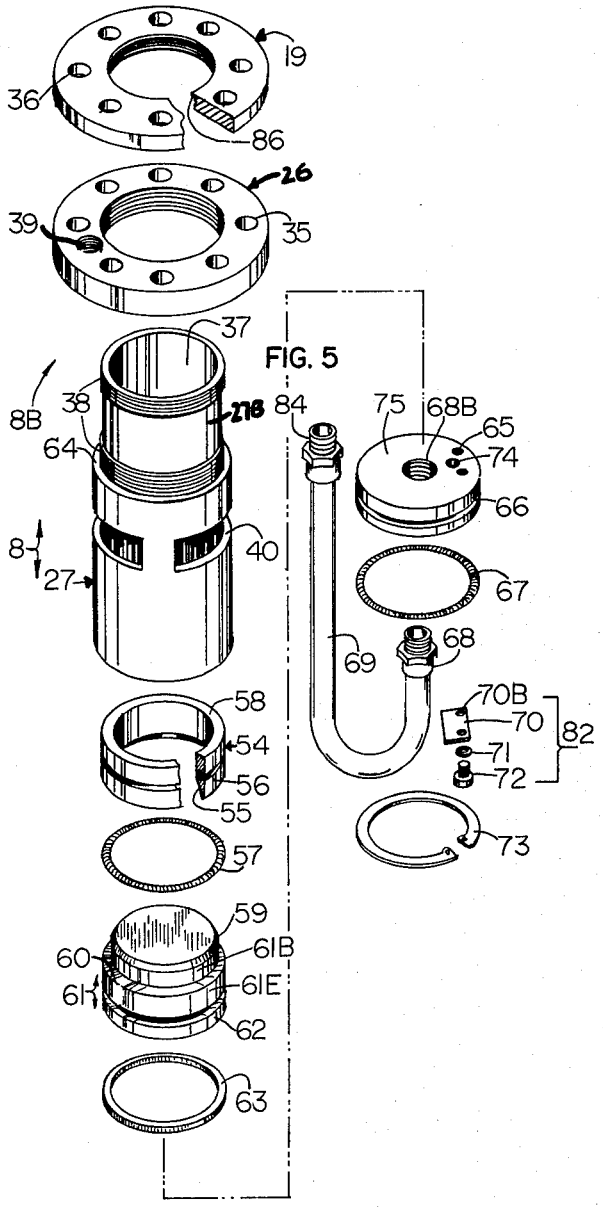
FIG. 5 is an exploded, isometric view of the preferred blast output pipe assembly.
Figure 6:
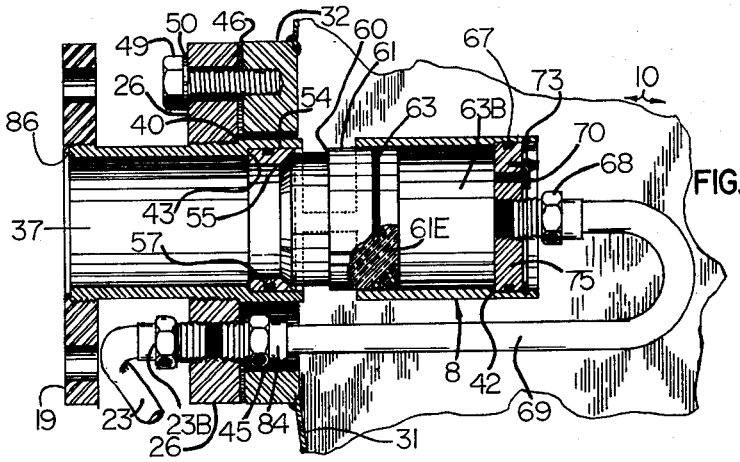
FIG. 6 is an enlarged fragmentary side view of the assembled blast discharge pipe assembly, with the piston shown in the aerator fill position; and, FIG. 7 is an exploded isometric view illustrating an alternative check valve and end cap assembly.

As best viewed in FIGS. 5 and 6, the blast pipe apparatus 8 includes a cylindrical valve piston seat assembly, generally designated by the reference numeral 54. Seat 55 is chamfered at approximately forty-five degrees. The piston seat assembly 54 is coaxially received within pipe 27, its base 58 firmly abutting a valve seat stop 43. In other words, that portion of the discharge pipe between jamming surface 64 and vent orifices 40 is interiorly counterbored, whereby to provide a suitable stop or shoulder 43 for the valve seat assembly 54. Assembly 54 preferably includes a conventional O-ring 57 seated within an intermediate O-ring groove 56.

A dual diameter piston, generally designated by the reference numeral 61, is slidably, coaxially disposed within the tube body 27. The piston includes a front, reduced diameter portion 61B separated from a larger diameter main portion 61E by a shoulder 60. Importantly, the leading edges of the reduced diameter piston portion are chamfered as indicated at 59. As will be described in greater detail hereinafter, this chamfered, leading surface 59 of piston 61 mates with similarly chamfered piston seat surface 55 to provide an air tight seal. A O-ring groove 62 is defined in piston portion 61E whereby to receive a conventional O-ring or quad ring 63. As best indicated in FIG. 6, piston 61 is slidable between blocking engagement with the piston seat 55 and a rearward position towards end cap 75.

Figure 3:
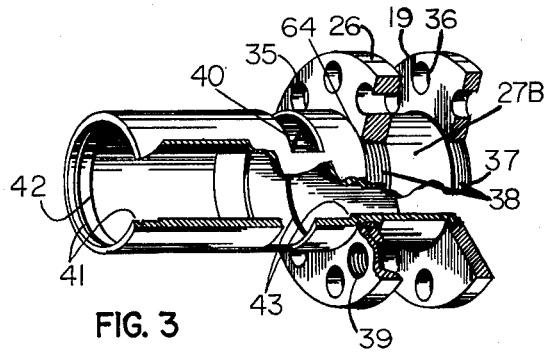
FIG. 3 is an enlarged, isometric view of a portion of a blast discharge pipe assembly output pipe constructed in accordance with the teachings of this invention, with parts thereof shown in section or broken away for clarity.

End cap apparatus 75 is of generally circular cross section, and includes a central O-ring groove 66 adapted to receive conventional O-ring 67. A pair of orifices 65 are threadably defined within its upper portion to receive mounting screws 72, whereby to secure check valve assembly 82, as will later be described. End cap 75 is fitted in the rear of the tube 27, being restrained by a ridge or counterbore 42 (FIG. 3). A retaining ring 73 received within groove 41 (FIG. 3) secures the end cap against rearward axial withdrawal. As best viewed in FIG. 6, it will be appreciated that a cavity, generally designed by the reference numeral 63B, is defined within tube 27 between the piston 61 and the end cap 75. Control of the blast aerator apparatus 10 is effectuated by pressurizing or depressurizing this important cavity 63B.

Air is delivered under pressure into cavity 63B via a pipe 69 fitted to end cap threaded orifice 68B with NPT male connector 68. The opposite end of pipe 69 terminates in a forwardly projecting male NPT connector 84 which penetrates tank flange cut out 45 (FIG. 4) and is threadably secured within threaded NPT fill pipe port 39 provided in tank bolting flange 26 (FIG. 5). An external air line 23 is coupled at the outside end of orifice 39 (FIG. 5) via an NPT male fitting 23B (FIG. 6). Fill hose 23 is coupled to a conventional three way, normally open, electrically activated solenoid valve, generally designated by the reference numeral 24 (FIG. 1, 2). An external supply of compressed air (not shown) is delivered to solenoid valve 24 via a line 25. Solenoid valve 24 thus controls pressurization of cavity 63B within the blast discharge tube assembly 27. To this effect valve 24 includes an exhaust orifice 29 for venting cavity 63B as will later be described.

To initiate operation of the blast aerator 10 the entire tank interior must be pressurized. Solenoid valve 24 normally conducts pressurized air from tube 25 to tube 23 whereby to introduce pressure into cavity 63B via tube 69. A check valve assembly 82 is secured to end cap 75 by a pair of spaced-apart bolts 72, including washers 71, through orifices 70B, being threadably received within end cap orifices 65. Flapper 70 thus yieldably blocks fill hole 74 (FIG. 5) defined through end cap 75. Thus, as air is introduced into cavity 63B via tube 69, piston 61 will be urged to the "aerator fill" position indicated in FIG. 6. At this time pressure within cavity 63B will be sufficient to maintain a seal between chamfered reduced diameter lip 59 and its mate 55. However, sufficient pressure will be developed to overcome check valve flapper 70, and tank 10 will gradually become pressurized until it is equal in pressure to the pressure within cavity 63B.

When it is desired to fire the apparatus, cavity 63B must be depressurized. In other words, when it is desired to generate a blast, solenoid valve 24 will be actuated electrically, and cavity 63B will be vented through solenoid vent 29. Immediately the difference in pressure between cavity 63B and the interior of the blast aerator will act upon the piston shoulder 60, which separates the increased diameter portion 61E of piston 61 from its reduced diameter portion 61B. Immediately the piston will be thrust rearwardly towards the end cap, exposing the high pressure contents of the aerator tank 10 to the tube vents 40 (FIG. 5). Immediately air will rush through vents 40, through the tube and out orifice 37, and thence through various tubes 21 or other connections as desired. The blast is substantial, and virtually instantaneous. Immediately afterwards recharging of the apparatus commences when valve 24 repressurizes line 23. Thus, operation may be controlled with intermittent, timed electric pulses of conventional origination.

Figure 7:
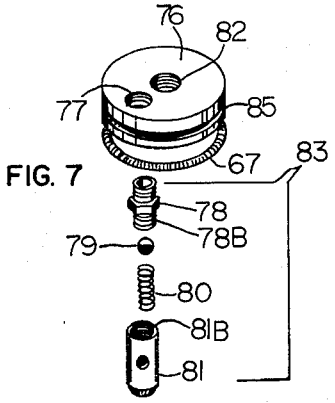

With reference now to FIG. 7, an alternative end plate 76 is disclosed. End plate 76 may be used in substitution for end plate 75 previously described. To this effect end cap 76 includes a central, threaded NPT orifice 82 adapted to receive NPT fitting 68 of pipe 69 (FIG. 6) already described. An O-ring groove 85 is included to permit installation of an O-ring, such as O-ring 67. It is contemplated that the end cap 76 will be secured in place at the rear of pipe 27 with a snap rink such as snap ring 73 (already discussed) which will be received within tube groove 41 (FIG. 3). An associated, alternative check valve assembly is generally designated by the reference numeral 83. It includes an NPT nipple 78 threadably received within suitable NPT threaded fill hole 77. Outer threaded nipple portion 78B receives threaded sleeve portion 81B of the check valve body 81, housing spring 80 and ball 79 therewithin. As will be appreciated by those skilled in the art, check valve assembly 83 will permit the pressurization of the blast aerator 10 once cavity 63B is pressurized to overcome yieldable resistance from spring 80. From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A blast aerator comprising:

a generally cylindrical, rigid tank having an axis, and a front end fitted with a blast discharge opening coaxially aligned with respect to said axis;

a rigid, elongated, tubular, blast discharge pipe adapted to be coaxially secured and aligned within said tank, said pipe having a front output end, a rear end positioned interiorly of said tank, a counterbored, internal front shoulder seat, and a predetermined intermediate internal diameter;

a piston seat assembly coaxially positioned within said blast discharge pipe in abutting relation with respect to said internal shoulder, said seat assembly including a rear, chamfered seat;

a resilient, generally cylindrical, dual diameter piston coaxially disposed within said blast discharge pipe and axially displaceable between an aerator tank fill position and an aerator tank exhaust position; an intermediate portion of said piston having a diameter substantially equal to said blast output pipe predetermined intermediate diameter, and a front portion of said piston having a diameter less than said piston intermediate diameter portion and terminating in a front, chamfered portion adapted to matingly engage said piston seat assembly chamfered seat when said piston assumes aid aerator fill position;

said piston including a shoulder defined between said intermediate diameter portion thereof and said reduced diameter portion thereof, said shoulder forming a working surface against which tank pressure may urge said piston toward said rear end of said blast discharge pipe in response to venting of said cavity;

vent means defined in said blast discharge pipe for outputting air temporarily stored within said tank through said blast discharge pipe front ouptut end in response to movement of said piston to said aerator tank exhaust position;

end cap means adapted to be coaxially, sealingly coupled to said blast discharge pipe rear end for limiting rearward axial displacement of said piston, the end cap means operable to define a sealed cavity between it and said piston at the rear of said blast discharge pipe; and, valve control means in fluid flow communiation with said cavity for filling said cavity and thus said tank and for subsequently initiating an output blast by venting said cavity, said valve control means comprising:

first air injection fitting means coupled to said end cap means for injecting air into said cavity rearwardly of said piston whereby to pressurize said cavity and move said piston into sealing engagement with said chamfered seat;

check valve means coupled to said end cap in fluid flow communciation with said cavity for pressurizing the interior of said tank in response to pressurization of said cavity; and, solenoid valve means for first actuating said air injection fitting means whereby to fill said tank through said check valve means and then depressurizing said cavity at a preselected time whereby to suddenly exhaust said tank through said output pipe in response to resultant rearward displacement of said dual diameter piston.

2. The combination as defined in claim 1 wherein said solenoid valve means is located exteriorly of said tank.

3. The combination as defined in claim 2 wherein:

said blast discharge pipe is coupled to said tank blast discharge opening by a flange secured to said blast discharge pipe and mated to a similar flange coaxially secured to said blast discharge opening;

a second air injection fitting means is fitted through said flanges at the front of said tank;

an internal hose is coupled between said first and second air injection fitting means; and, said solenoid valve means is coupled to said second injection fitting means at the front of said tank.

4. A blast aerator discharge pipe assembly adapted to be mechanically coupled to a generally cylindrical, rigid, tank, the front tank end having a blast discharge opening, said discharge pipe assembly comprising:

a rigid, elongated, tubular, blast discharge pipe adapted to be secured to said blast discharge opening, said pipe having a front output end, a rear end adapted to be positioned interiorly of said tank, a couterbored, internal front shoulder seat, and a predetermined intermediate internal diameter;

a piston seat assembly coaxially positioned within said blast discharge pipe in abutting relation with respect to said internal shoulder, said seat assembly including a rear, chamfered seat;

a resilient, generally cylindrical, dual diameter piston coaxially disposed within said blast discharge pipe and axially displaceable between an aerator tank fill position and an aerator tank exhaust position; an intermediate portion of said piston having a diameter substantially equal to said blast output pipe predetermined intermediate diameter, and a front portion of said piston having a diameter less than said piston intermediate diameter portion and terminating in a front, chamfered portion adapted to matingly engage said piston seat assembly chamfered seat when said piston assumes aid aerator fill position;

said piston including a shoulder defined between said intermediate diameter portion thereof and said reduced diameter portion thereof, said shoulder forming a working surface against which tank pressure may urge said piston toward said rear end of said blast discharge pipe in response to venting of said cavity;

vent means defined in said blast discharge pipe for outputting air temporarily stored within said tank through said blast discharge pipe front output end in response to movement of said piston to said aerator tank exhaust position;

end cap means adapted to be coaxially, sealingly coupled to said blast discharge pipe rear end for limiting rearward axial displacement of said piston, the end cap means operable to define a sealed cavity between it and said piston at the rear of said blast discharge pipe; and, valve control means in fluid flow communication with said cavity for filling said cavity and thus said tank and for subsequent initiating an output blast by venting said cavity, said vent control means comprising:

first air injection fitting means coupled to said end cap means for injecting air into said cavity rearwardly of said piston whereby to pressurize said cavity and move said piston into sealing engagement with said chamfered seat;

check valve means coupled to said end cap in fluid flow communication with said cavity for pressurizing the interior of said tank in response to pressurization of said cavity; and, solenoid valve means for first actuating said air injection fitting means whereby to fill said tank through said cavity at a preselected time whereby to suddenly exhaust said tank through said output pipe in response to resultant rearward displacement of said dual diameter piston.

5. The combination as defined in claim 4 wherein said solenoid valve means is adapted to be located exteriorly of said tank.

6. The combination as defined in claim 5 wherein:

said blast discharge pipe is coupled to said tank blast discharge opening by a flange secured to said blast discharge pipe and mated to a similar flange coaxially secured to said blast discharge opening;

a second air injection fitting means is fitted through said flanges at the front of said tank;

an internal hose is coupled between said first and second air injection fitting means; and, said solenoid valve means is coupled to said second injection fitting means at the front of said tank.

* * * * *